US005802797A

United States Patent [19]

Storer-Folt

[11] Patent Number: 5,802,797

[45] Date of Patent: Sep. 8, 1998

[54] DRY-STACKABLE MASONRY UNIT AND METHODS OF MANUFACTURE AND USE

[75] Inventor: John Storer-Folt, Mississauga, Canada

[73] Assignee: Jannock Limited, Ontario, Canada

[21] Appl. No.: 578,185

[22] Filed: Dec. 29, 1995

[30] Foreign Application Priority Data

Dec. 30, 1994 [AU] Australia ..... PN0331

[51] Int. Cl.[6] ..... E04B 5/04

[52] U.S. Cl. ..... 52/604; 52/606; 52/592.5

[58] Field of Search ..... 52/603, 604, 605, 52/606, 607, 564, 589.1, 592.5, 592.6

[56] References Cited

U.S. PATENT DOCUMENTS

| | | | |
|---|---|---|---|
| 2,736,188 | 2/1956 | Wilhelm | 52/606 X |
| 3,012,377 | 12/1961 | Sunkjian | 52/603 X |
| 4,031,678 | 6/1977 | Schurins | 52/592.6 X |

FOREIGN PATENT DOCUMENTS

| | | |
|---|---|---|
| 74302/81 | 12/1984 | Australia . |
| 2010175 | 8/1990 | Canada . |
| 2044928 | 12/1992 | Canada . |

*Primary Examiner*—Creighton Smith

*Attorney, Agent, or Firm*—Beveridge, DeGrandi, Weilacher & Young, LLP

[57] ABSTRACT

A masonry system in which specially shaped brick are dry-stacked and subsequently bonded by pouring mortar or grout into apertures in the brick to flow through the stacked structure to surround the individual brick leaving the front and rear faces exposed. The brick have alignment projections extending from the bottom bed faces which register with alignment grooves in the top bed faces of the lower brick to align the upper brick prior to bonding. The projections and grooves define a recess to admit mortar between adjacent brick faces. The brick also have recesses in the header faces to admit mortar between adjacent header faces. The front faces of the brick are contoured to create the appearance of mortar joints when the brick are stacked. The brick may be manufactured by extrusion, wire cutting and final shaping using suitable blades to achieve the desired finished shape. If desired, certain apertures through the brick may be covered over using a suitably shaped blade operating under appropriate conditions.

14 Claims, 11 Drawing Sheets

DRY-STACKABLE MASONRY UNIT AND METHODS OF MANUFACTURE AND USE

FIELD OF THE INVENTION

The present invention relates to a masonry unit configuration, a method of making such a configuration and a method of erecting unit masonry structures using the masonry unit of the present invention.

BACKGROUND

Methods of constructing day and other material brick or block and brick or block walls are long known. The methods comprise laying brick course by course, in one of many standard patterns or configurations, with a course of mortar or grout between each row of brick and between adjacent brick in a row. The laying of such a brick wall is time consuming and requires a degree of skill as the brick must be laid in an even manner and in substantially straight lines with even mortar or grout layers in between to achieve a pleasant aesthetic effect as well as providing the required structural characteristics. In more recent times, "brick" have been made by molding suitable concrete mixes in a standard mould to form a hollow block or brick. These block or "brick" are then laid in the manner described above. Lightweight, hollow, concrete "brick" are also known which can be readily sawn by hand and erected using a synthetic or other suitable glue (as distinct from mortar) to "join" the brick together and to "cement" them in place. Walls constructed from such brick lack a certain aesthetic appeal due to the absence of the well known mortar jointing which is clearly visible in a standard brick wall.

It is also known to manufacture "prefabricated" brick panels by placing brick in a formwork or in a desired pattern on a suitable flat surface with the necessary gaps between the brick and then introducing, pumping or otherwise injecting mortar into the gaps between the brick and rows of brick. Once the mortar has cured and set, the panel can be transported to and erected at a remote location. Care must be taken in manufacturing "prefabricated" brick panels in such a manner as the mortar joint is the weakest part of the panel and the panel can break at the mortar joints if not transported, handled and erected with sufficient care.

It is a known problem that a standard brick wall has other disadvantages, in that while a brick has an extremely long life, the life of a brick wall is limited to some extent by the life of the mortar holding the brick in place. In exposed conditions, the mortar can be eroded by chemical, wind, rain, sand and/or dirt particle action resulting in a weakened or aesthetically less pleasing structure. Alternatively, shrinkage of the mortar may lead to separation of the brick and mortar or cracks in the mortar leading to water penetration and possibly damage to the masonry.

DISCUSSION OF PRIOR ART

U.S. Pat. No. 2,114,906 (Nyhagen) discloses a brick construction method using a mastic "cement" to adhere the brick together with "closed end" pieces to prevent the mastic from oozing out on to the face of the building. U.S. Pat. No. 2,141,035 (Essen) discloses refractory brickwork having corresponding keyways in the upper and lower (bed) faces and end (header) faces for positioning the brick or units. There are no cores or holes through the brick into which mortar or grout can be introduced to fix the brickwork in position. There is also no mention of any particular configuration of the face of the brick of the brickwork. U.S. Pat.

No. 2,239,127(Swenson) discloses the use of a prefabricated joint material which is suitably adhered in place between the courses of brick and between the brick in each course. The width of the joint material may be such that a gap between the brick at the face of a wall may be pointed. U.S. Pat. No. 2,413,268 (Unverferth) discloses a seal/spacer for a brick having frogs on each bedding face. U.S. Pat. No. 2,687,034 (Blanc) discloses a brick ("wall unit") for use with adhesive gaskets having vertically and horizontally offset front and rear faces which form tongue and groove interlocking means. U.S. Pat. No. 4,075,808 (Pearlman) discloses a brick ("wall unit") having vertically and horizontally offset front and rear faces which form tongue and groove interlocking means. The brick also have bed face to bed face passages and header to header channels to allow cement to be poured into the brick to rigidly hold the brick in position. The offset faces are specifically disclosed as providing effective dams preventing the seepage of liquid cement to the outside surface of the wall. The specification also specifically discloses "appropriate" corner, end and interior block U.S. Pat. No. 4,095,384 (Zarriello) discloses a tar coated strip joint material for correct and easy aligning of brick. The width of the joint material may be such that the gap between the brick at the face of the wall may be pointed with e.g. mortar or pitch. U.S. Pat. No. 4,123,881 (Muse) discloses specially shaped brick which include vertical cavities and horizontal passages for the introduction of cement to hold the brick together. The specification also includes the use of clips to initially hold the brick in position. U.S. Pat. No. 4,319,440 (Rassias) discloses specially shaped brick which include vertical cavities and horizontal passages for the introduction of cement to hold the brick together. The specification is directed to overcoming disadvantages of the identified prior art, which does not allow for the use of continuous reinforcing bars from top to bottom, end to end and around corners. U.S. Pat No. 4,573,301 (Wilkiunson) discloses hollow brick having tongues (24) and tongue receiving grooves or rabbeted edges (26) to align the brick which allows for the introduction of a cement into the cavities of a wall formed by the brick. U.S. Pat. No. 4,614,071 (Sams) discloses a brick ("resinous foam building block") for use with adhesive gaskets having vertically and horizontally offset front and rear masonry slab faces adhered thereon which form tongue and groove interlocking means. The disclosure suggests that a wall may be constructed with the brick without the use of e.g. mortar.

U.S. Pat. 4,833,852 (West) discloses an insulating insert unit to be inserted in a hollow building block. The specification places no importance on the external features of the building block. U.S. Pat. No. 4,887,403 (Bonner) discloses a hollow building block an interlocking brick configuration which can be used with or without mortar. The specification places no importance on the external features of the building block. U.S. Pat. No. 5,226,267 (D'Antonio) discloses acoustical diffusing and absorbing cinder block which are assembled through the use of mortar. The block are of complex shape. The specification places no importance on the external features of the building block. U.S. Pat. No. 5,248,226 (Risi) discloses a number of male and female interlocking projections for block for use in a retaining wall structure. The specification places no importance on the external features of the building block. PCT/SE82/00097 (Hedstom) discloses preformed cement based jointing members, having the thickness and appearance of a conventional masonry joint, which are glued to building stones to form a wall. The specification places no importance on the external features of the building block. Canada 1,203,395

(Mund) discloses block similar to those disclosed by Wilkinson U.S. Pat. No. 4,573,301 (above). The specification is directed to the use of rubber or neoprene sealing gasket between the block in a wall. The hollow block may be filled with earth, rock or concrete to increase the strength of the completed wall. The specification does not place any importance on the external features of the building block. Australia Pat. No. 75,302/81 (Mund) discloses block similar to those of the Canadian patent (above) but is not restricted to the inclusion of the rubber or neoprene gasket. The specification does not place any importance on the external features of the building block Italian Pat. No. 607539 discloses a masonry block and a wall erected from such block in which the block are placed directly above each other with the core holes lining up. Reinforcing rods may extend upwardly from a foundation into the core holes. Concrete, mortar or grout is poured down selected core holes to, in effect, create concrete pillars within the wall. The block do not have any aligning means to align the block during stacking and lack any simulated mortar joints which would create a brick-like appearance. If these brick were placed in running bond rather than one directly above the other, the core holes would not line up.

None of the prior art addresses the problem of manufacturing brick or discloses brick which are simple to erect in wall or wall panel form which have the appearance of a standard brick wall and which avoid at least some, if not all, of the above disadvantages of known brick wall constructions nor discloses any methods or apparatus for manufacturing such brick.

The present invention proposes to overcome or reduce sore or all of the disadvantages of the prior art by providing a brick of novel configuration and a method of construction of a brick wall using the brick. The brick and method of the invention is particularly useful in the construction of prefabricated brick panels.

SUMMARY OF THE INVENTION

A brick having front and rear faces, header faces and top and bottom bed faces. A recess extends into the top bed face and at least one projection extends from the bottom bed face. The projection is registerable at least along an edge with the recess of an underlying brick to align the brick and to define a space for mortar or grout. A recess extends into at least one of the header faces to partially define an aperture which in conjunction with an adjacent header face of an adjacent brick defines an aperture for admitting mortar or grout between the header faces. The front face has at least some portions contoured to at least partially resemble the contour of a mortar joint so that the edges of adjacently stacked brick combine to resemble the appearance of mortar joints between the brick.

A method of erecting a brick structure comprising the steps of:

1. stacking a plurality of courses of brick as described above in running bond with the projections and recesses registering to align the bricks and to define a fluid conduit between adjacent faces of said brick;
2. pouring mortar or grout into at least some of the apertures to flow through said fluid conduit and form a continuous joint around the brick between adjacent faces, leaving the front and rear faces exposed.

A method of manufacturing a day brick as described above comprising the steps of:

1. extruding and wire cutting a day column into individual blocks having top and bottom bed faces, header faces, a front face, a rear face, and at least one aperture extending between the top and bottom bed faces;
2. using cutting blades to remove day to form a recess in the top bed face extending between the header faces, a projection in the bottom bed face extending between the header faces, and to contour at least some portions of the front face to at least partially resemble the profile of a mortar joint;
3. drying and firing the brick.

DESCRIPTION OF DRAWINGS

Preferred embodiments of the present invention are described in detail below with reference to the accompanying drawings in which.

DESCRIPTION OF PREFERRED EMBODIMENT

Although much of the following description relates to clay or concrete brick or block, the present invention, at least insofar as the shape of the brick, its use and some of the manufacturing methods, may lend itself to other unit masonry materials. Accordingly, the expression "brick" is used herein to refer to any suitable masonry units shaped in the preferred configurations.

The brick of the present invention are for use in masonry structures which are assembled by first stacking the brick in a desired configuration and subsequently pouring mortar or grout into apertures in the top of the uppermost course of brick from whence the mortar or grout flows through the dry-stacked structure to bond the individual brick together. The individual brick are preferably provided with apertures as well as projections and recesses which, when dry-stacked combine or cooperate to define a fluid conduit through which the mortar or grout flows both through apertures in the brick and between adjacent brick faces to extend around the perimeter of the brick. These aspects are discussed in more detail below.

Figure 1:
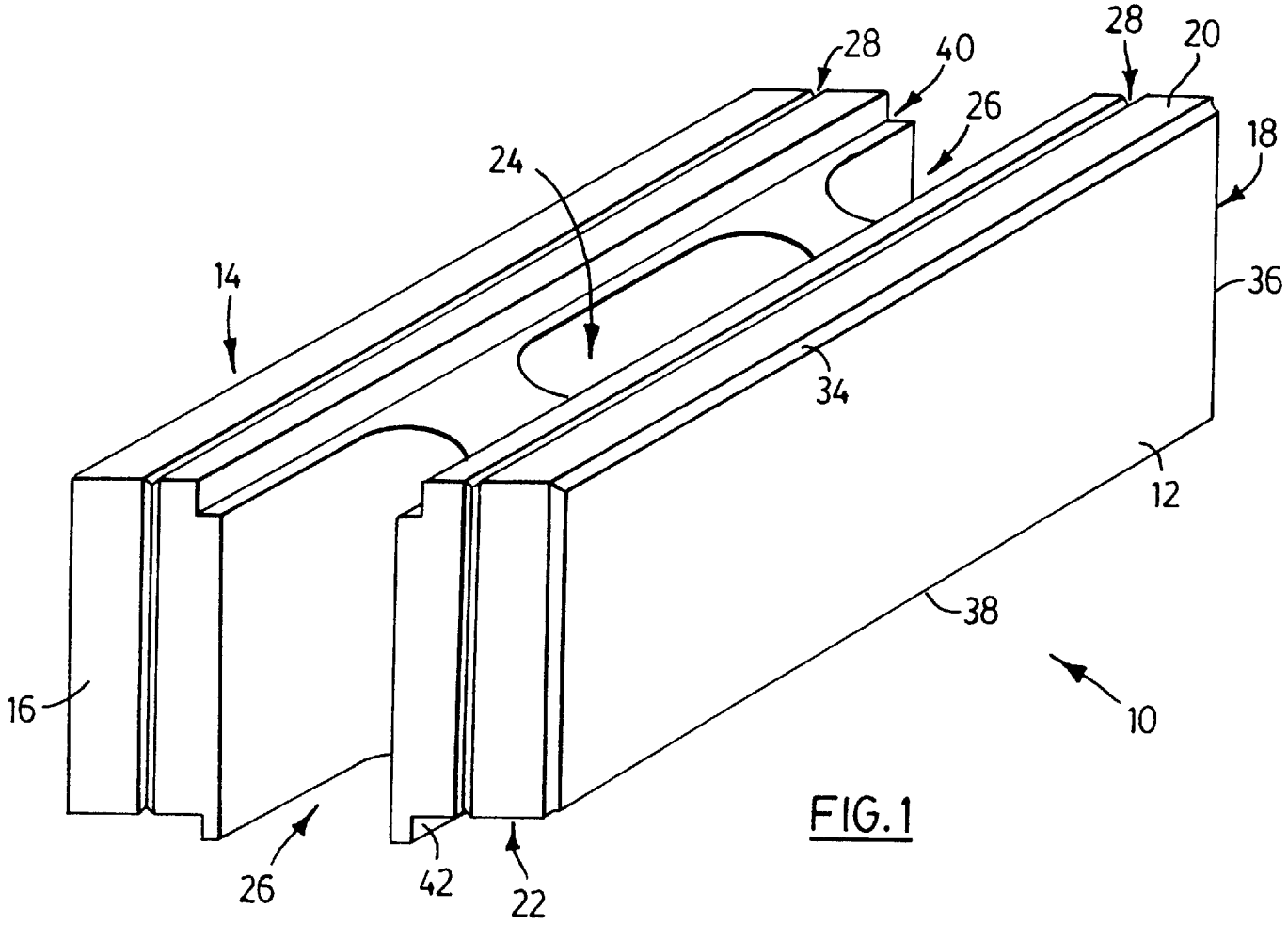
FIG. 1 is a perspective view of a brick according, to the present invention.

In FIG. 1, a brick according to the present invention is generally illustrated by reference 10. The brick has a front face 12, a rear face 14, header faces 16 and 18, a top bed face 20, and a bottom bed face 22. An aperture 24 extends vertically through the centre of the brick 10 between the top bed face 20 and bottom bed face 22. Partial apertures 26 extend into the front and rear faces, 12 and 14 respectively and between the top and bottom bed faces, 20 and 22 respectively.

The brick 10 has grooves 28 extending around its perimeter, parallel to but spaced inwardly from the face 12 and rear face 14. Each of the grooves 28 partially defines a "mortar stop" as discussed in more detail below.

The upper edge 34 between the front face 12 and top bed face 20 is contoured to resemble at least a portion of a conventional mortar joint. Similarly the edges 36 of the front face 12 adjacent the header faces 16 are also contoured to resemble at least a portion of a mortar joint. In FIG. 1, the edges 34 and 36 are inwardly curved. Other configurations such as a bevel may also be used as discussed in more detail below. Similarly, the bottom edge 38 between the bottom bed face 22 and the front face 12 may also be contoured.

The brick 10 has a groove or recess 40 extending into the top bed face 20 and running along its entire length, generally parallel to the front and rear faces 12 and 14, respectively. The bottom bed face 22 has a similarly shaped tongue or projection 42 extending outwardly from the bottom bed face 22 and running the entire length of the bottom bed face 22.

Figure 2:
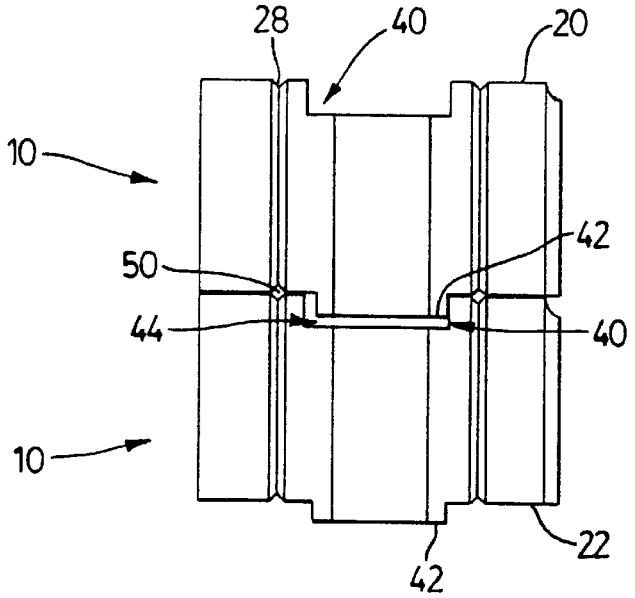
FIG. 2 is an end view of two brick according to the present invention stacked one above the other.

As shown in FIG. 2, the projections 42 are of slightly larger dimension than the recesses 40 to enable the projection 42 to nest within the recess 40 of the underlying brick and define a space 44 therebetween, through which mortar or grout may flow.

Figure 3:
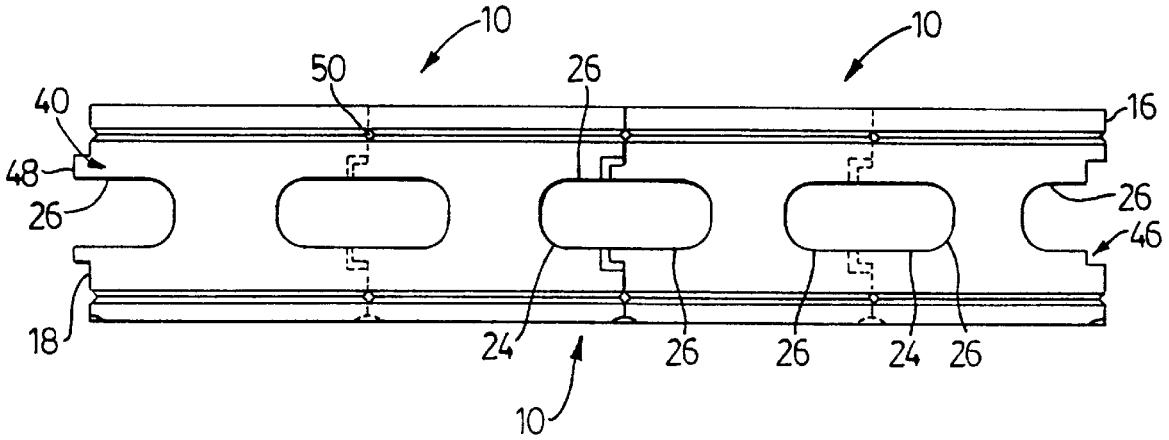
FIG. 3 is a plan view of a section of brickwork according to the present invention.
Figure 3A:
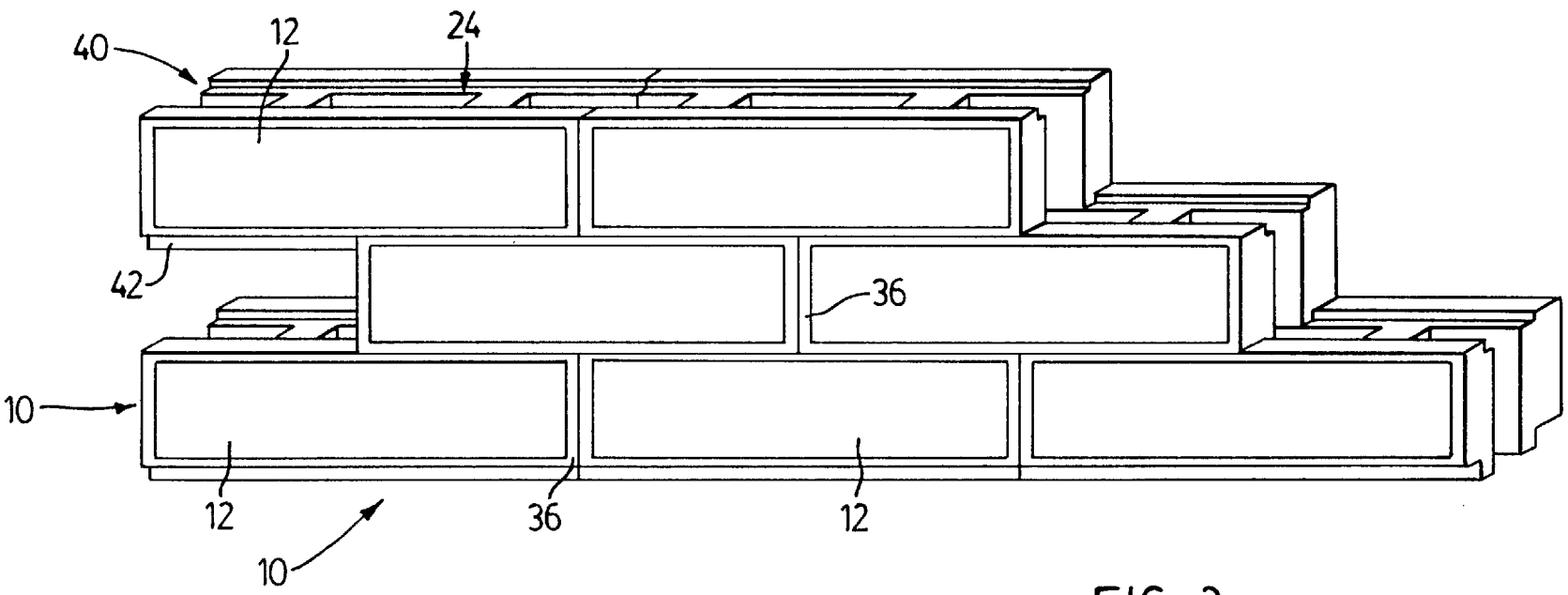
FIG. 3*a* is a perspective view of a section of brickwork according to the present invention.

FIG. 3 shows a top view of a series of brick according to the present invention placed one above the other in "running bond" wherein the space between adjacent header faces approximately overlies the centre of the underlying top bed face. The dashed lines in FIG. 3 indicate the components of the brick in the course underlying that being viewed in FIG. 3. FIG. 3*a* is a perspective view of a dry-stacked series of brick according to the present invention. Mortar stops have been omitted from FIG. 3*a* for the sake of clarity.

As can be seen from FIGS. 3 and 3*a*, the partial apertures 26 of adjacent brick 10 combine to form an aperture resembling the aperture 24 Furthermore, the aperture defined by the adjacent partial apertures 26 registers with the aperture 24 in the underlying brick 10 to in effect define a column extending vertically through the brick structure. The columns so defined by the partial apertures 26 and apertures 24 may be used to receive reinforcing members, such as steel rods or the like extending upwardly through the brickwork.

The partial apertures 26 furthermore define a receptacle for receiving mortar between the adjacent header faces 16 and 18 to both provide a lateral bond and a moisture barrier between the header faces 16 and 18.

When mortar is poured into the apertures 24 and those defined by the partial apertures 26, it also flows horizontally through the space. 44 between adjacent top bed faces 20 and bottom bed faces 22. This not only bonds vertically adjacent brick 10 but also provides a moisture barrier horizontally and vertically through the brickwork. If desired, the space 44 may be large enough to accommodate reinforcing members which may be placed prior to placement of the overlying brick.

It will therefore be appreciated that the apertures 24, the spaces defined by adjacent partial apertures 26, and the spaces 44 defined by the projections 42 and recesses 40 provide a fluid conduit through which mortar or grout may flow through the apertures 24 in brick 10 and around the header faces 16 and 18, the top bed face 20 and bottom bed face 22 to entirely surround the brick leaving only the front face 12 and rear face 14 exposed.

It has been found that when mortar or grout is introduced into dry-stacked brickwork according to the present invention, it has a tendency to seep out of the spaces between adjacent brick faces. This affects the aesthetic appearance of the completed structure. In order to minimize or eliminate seepage, the brick 10 may be provided with grooves 28. As shown in FIG. 2 and FIG. 3, adjacent grooves 28 define a cavity or "mortar stop" 50 therebetween. The tendency of mortar or grout to seep between adjoining brick faces diminishes as the fluidity of the mortar or grout diminishes, which occurs as moisture is wicked from the mortar or grout into the brick The mortar stop 50 generally acts as a pool in which mortar or grout may collect thereby retarding the outward progress of the mortar or grout until its tendency to seep is diminished or eliminated by the wicking of moisture into the brick.

The projections 42 and recesses 40 serve to align the brick 10 during stacking. As shown in FIG. 3, further recesses 46 may be provided in the end faces 16 and projections 48 in the end faces 18. It is not necessary to configure the projections 48 and recesses 46 to define a space therebetween to receive mortar or grout as the partial apertures 26 accomplish this function. Some space is however preferable to accommodate manufacturing tolerances. If the brick 10 are made without partial apertures extending into the header faces, it would be desirable to allow a space for mortar or grout between the header faces.

Although ideally the projections 42 and 48 would nest tightly within the corresponding recesses 40 and 46, in practice, this is difficult to achieve without machining of the fired brick because of manufacturing tolerances and dimensional changes in the drying and firing processes. To avoid such machining, the recesses 40 and 46 may be made broader than the corresponding projections 42 and 48 to compensate for manufacturing tolerances.

Manufacturing tolerances may also be accommodated in several other ways. For example, the rows of brick may include, in between each row, a resilient material such as a synthetic plastics mesh material which is deformable between the sides of the projections and sides of the recesses to hold the two rows of brick in the correct relationship. The mesh material must be of a sufficiently large mesh size so as not to impede the passage or flow of the mortar or grout between the brick and of a width preferably such that it fits totally within the recess of the brick. Alternatively, as shown in FIG. 2, the width of the projection 42 in the front to rear face direction may be narrower than the width of the recess 40 in the same direction, with the front side of the projection 42 being aligned to abut against the front side of the recess 40 but with a gap between the rear side of the projection 42 and rear face of the recess 40.

Figure 10:
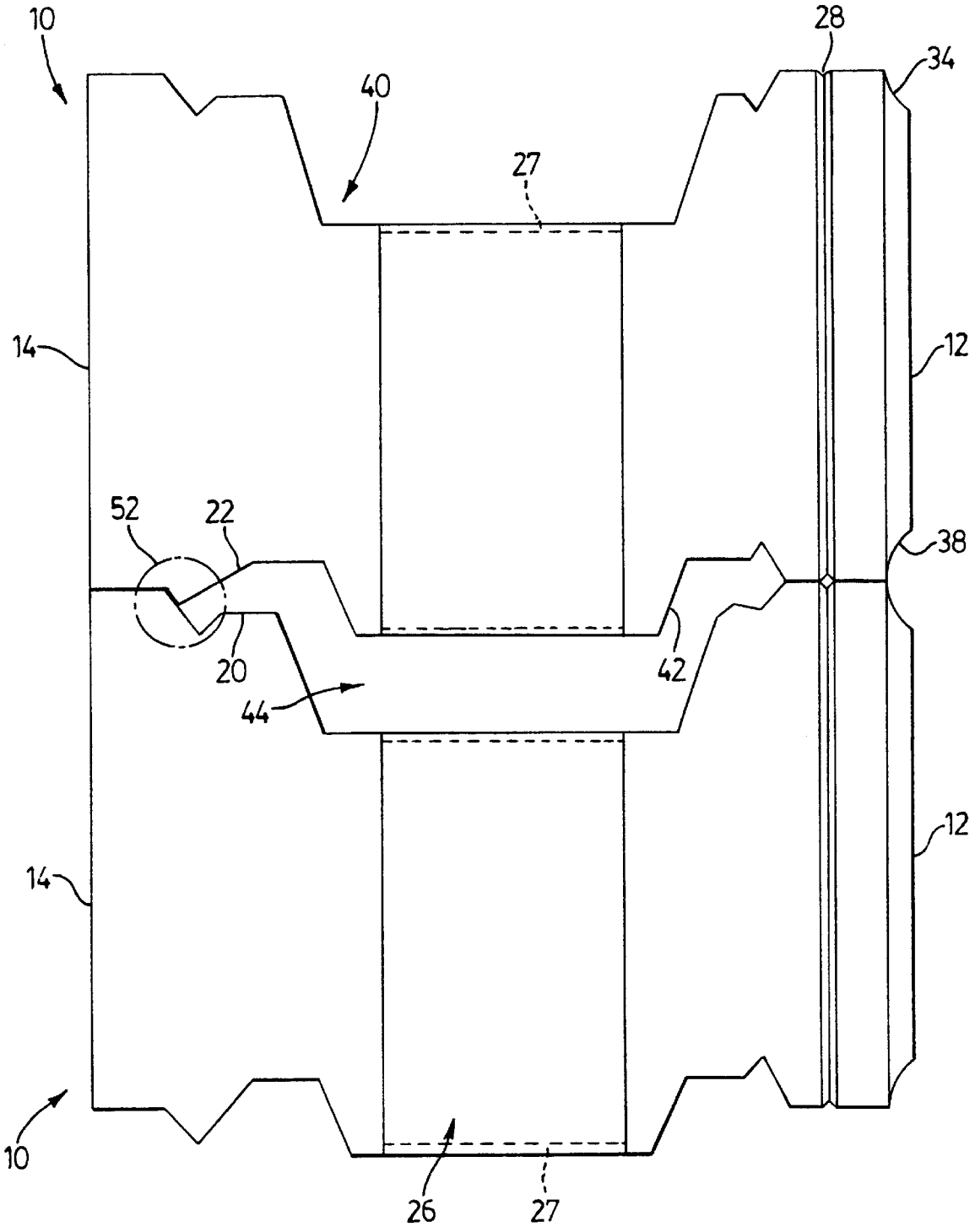
FIG. 10 is an end view of an alternate configuration of brick according to the present invention.

FIG. 10 illustrates the end view of an alternate brick configuration according to the present invention, having a groove 28 only adjacent to the front face 12 and in which alignment is provided at reference 52 by providing sloped mating face portions on the top and bottom bed faces 20 and 22 respectively. The contouring of the projection 42 and recess 40 in this configuration has been selected to define a convoluted mortar flow path having a length generally corresponding to the distance across a mortar joint in conventionally laid brick. The convoluted path is also intended to impede mortar flow laterally toward the front face 12 and rear face 14.

The edges 34 and 36 of the front face 12 of the brick 10 of the present invention may be formed with a contour which resembles a conventional mortar joint. The contoured portion may be painted to resemble mortar. A preferred method of creating a durable mortar-like appearance in the contoured portion in the case of day brick or block is to paint the contoured portion with an engobe containing suitable ceramic colouring agents prior to firing.

Figure 4:
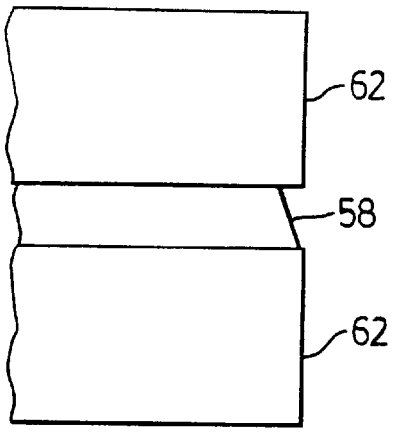
FIG. 4 shows a profile of a mortar joint.
Figure 5:
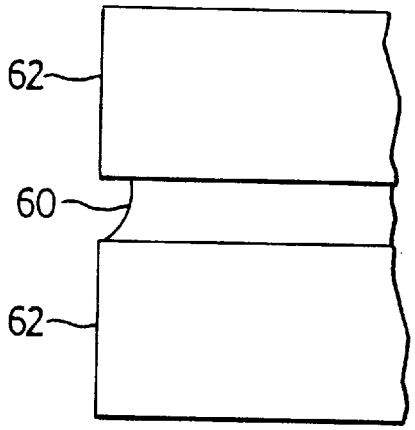
FIG. 5 shows a profile of an alternate mortar joint
Figure 6:
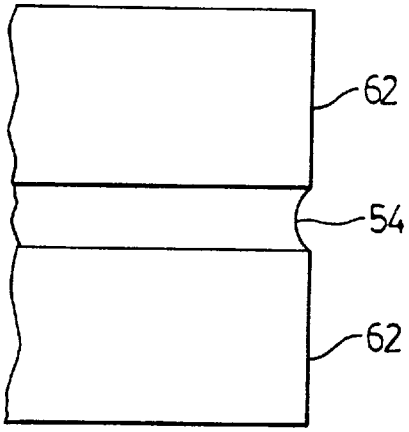
FIG. 6 shows a profile of yet another alternate mortar joint.
Figure 7:
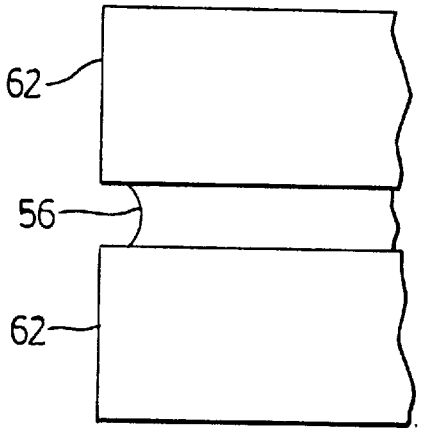
FIG. 7 shows a profile of still another mortar joint.

Although each of the edges 34, 36 and 38 may be contoured to resemble half of a mortar joint so that two adjacent edges will appear as a single mortar joint, other configurations may be preferable in certain environments. FIG. 6 illustrates a standard mortar joint 54 between two brick 62. FIG. 7 illustrates a recessed mortar joint at 56. FIG. 4 illustrates a beveled mortar joint at 58. FIG. 5 illustrates a semi-beveled mortar joint at 60.

In climatic regions where below-freezing temperatures are commonly experienced, it is desirable to avoid as much as possible the ingress of water into the mortar between courses. If water is absorbed by the mortar or seeps into spaces between the mortar and the brickwork, when the water freezes it may damage the brickwork. In such environments, beveled or semi-beveled type mortar joints are preferred as water running down the faces of the brick will tend to drip over the mortar joint rather than seep into it.

Figure 8:
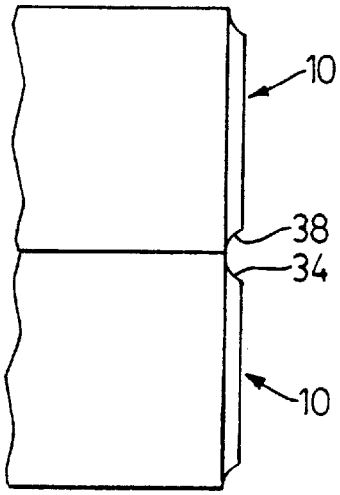
FIG. 8 shows a profile of the outer face of two to brick according to the present invention.

FIG. 8 illustrates edge contouring resembling a standard mortar joint. In the configuration illustrated in FIG. 8, the lower edge 38 and upper edge 34 are of corresponding curvature.

Figure 9:
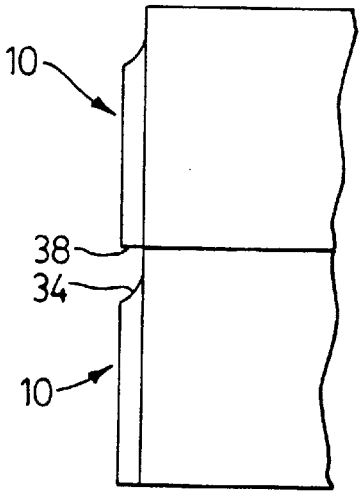
FIG. 9 shows a profile of an alternate outer face of two brick according to the present invention.

FIG. 9 illustrates edge contouring resembling a semi-beveled mortar joint. In the edge configuration illustrated in FIG. 9, the lower edge 38 of the overlying brick 10 is not recessed but rather is square. The upper edge 34 of the underlying brick 10 is contoured to resembled a semi-beveled mortar joint. The square edge 38 acts to cause water to drip down rather than seep into the space between the adjacent brick 10.

The simulated mortar joints may also be placed other than at the edges of the brick 10, for example, grooves in the form of a "+" allays be cut into the front face 12. Also, if relatively large brick are being used, it may be desirable to groove the front face 12 to resemble an arrangement of several smaller brick. Basically any contouring may be used as long as when with brick are stacked a desired overall pattern is created.

It is expected that brick according to the present invention may be made by several methods, including dry-pressing (clay or concrete), repressing and a combination of extrusion and machining. In the latter method, brick may be extruded along the axes of the cores and cut to the appropriate length and width in a conventional manner, such as by wire cutting. The top and bottom bed faces 20 and 22 respectively of the individual brick may then be cut or machined to form the recesses 40, projections 42 and grooves 28 while the brick is still "green" (ie. undried)

Figure 11:
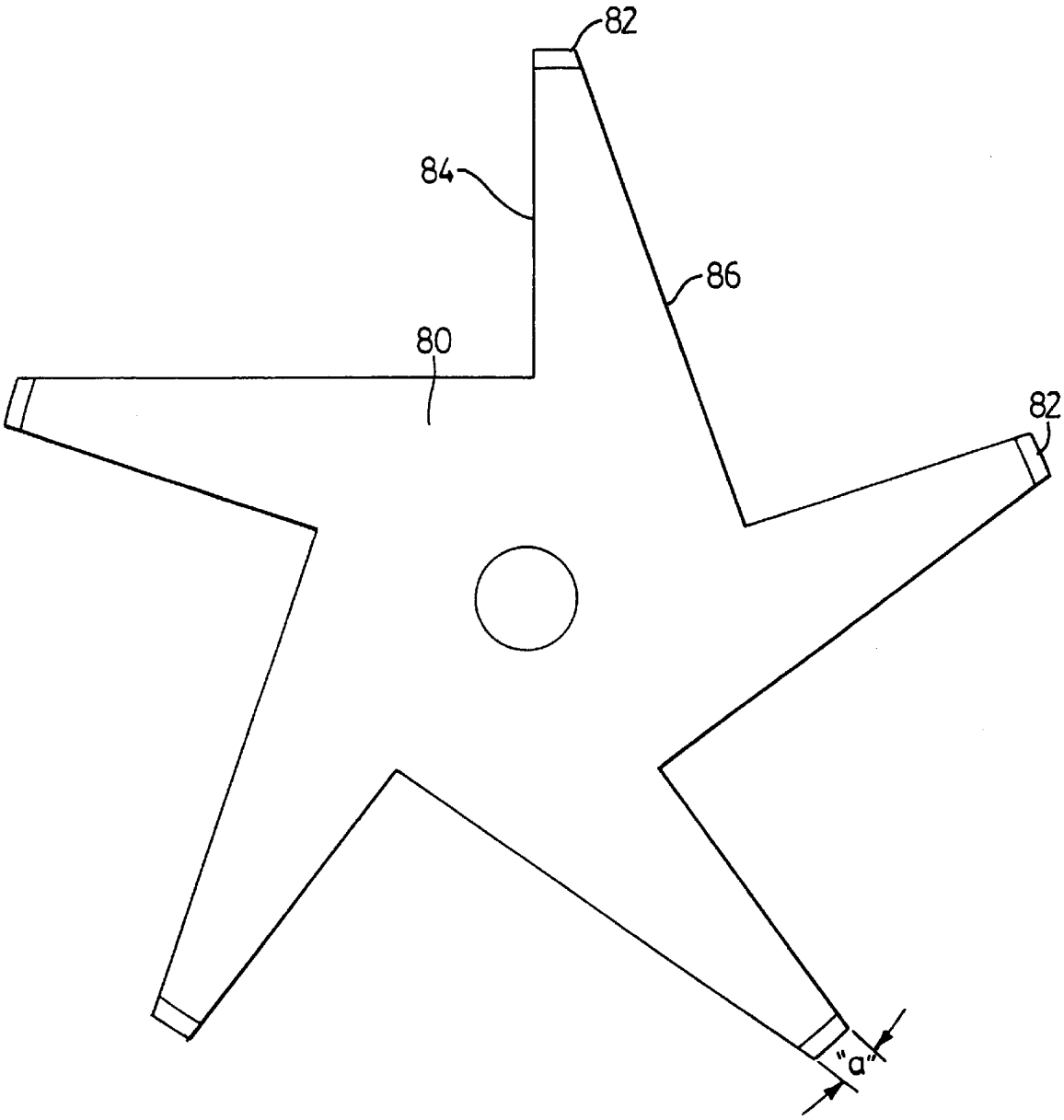
FIG. 11 is an end view of a cutting blade for shaping a brick according to the present invention.
Figure 12:
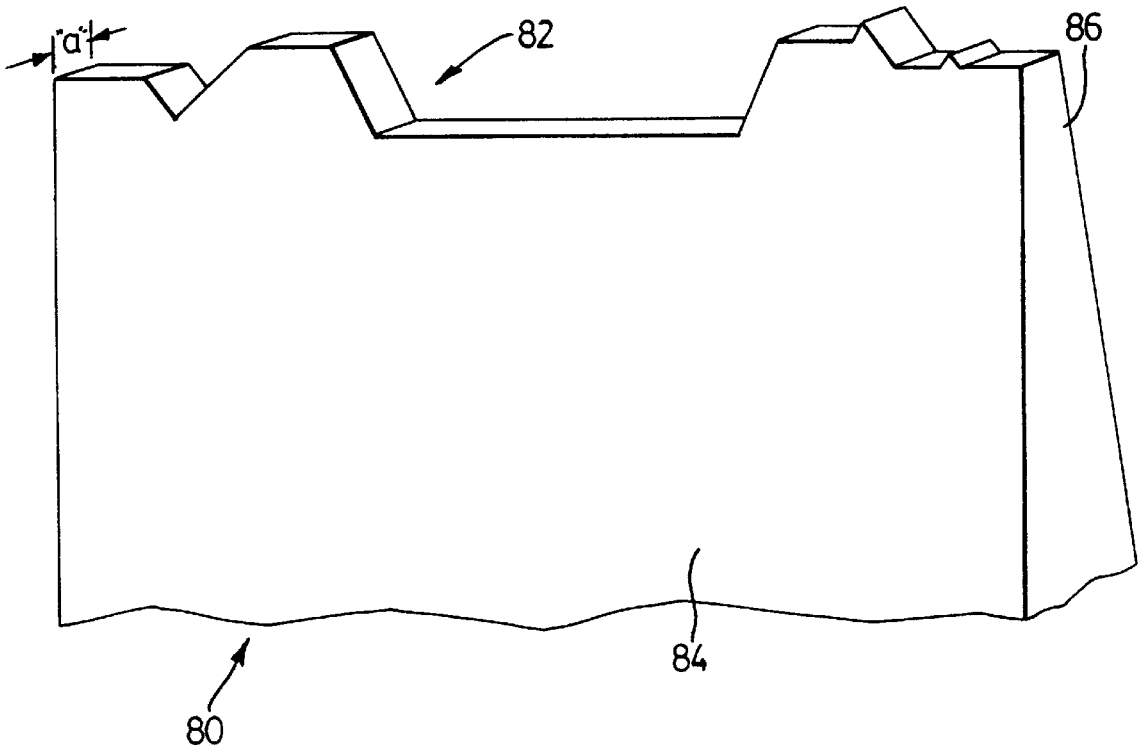
FIG. 12 is a perspective view showing the blade tip detail of a blade according to FIG. 11.

One way to machine the brick is to use a rotary cutting tool having a blade such as illustrated in FIGS. 11 and 12 at reference 80. FIG.11 is a view of the blade 80. The tip profile is illustrated in FIG. 12.

The blade 80 has five tips 82, each of which, as illustrated in FIG. 12, has a profile generally resembling the bottom bed face 22 of the brick 10, illustrated in FIG. 10. The blade has a tip diameter varying from 7⁄16" to 6¾". A shorter face of the blade 84 is approximately 2" deep and meets an adjacent longer face 86 at about right angles. The dimension "a" is approximately ¼

An interesting phenomenon which has been observed in utilizing a blade such as illustrated in FIGS. 11 and 12, rotating at approximately 1720 rpm, is that the blade tends to both cut and flow the clay. Using blades with significantly more tips will produce a relatively smooth machined surface in which the coarser particles are cut rather than dragged and in which blockage of the apertures 24 and partial apertures 26 is minimal. It has been found that a blade assembled from a series of carbide tipped circular saw blades placed adjacent one another on a common shaft and having 12 to 25 tips or teeth will produce a smooth machined surface.

Figure 13:
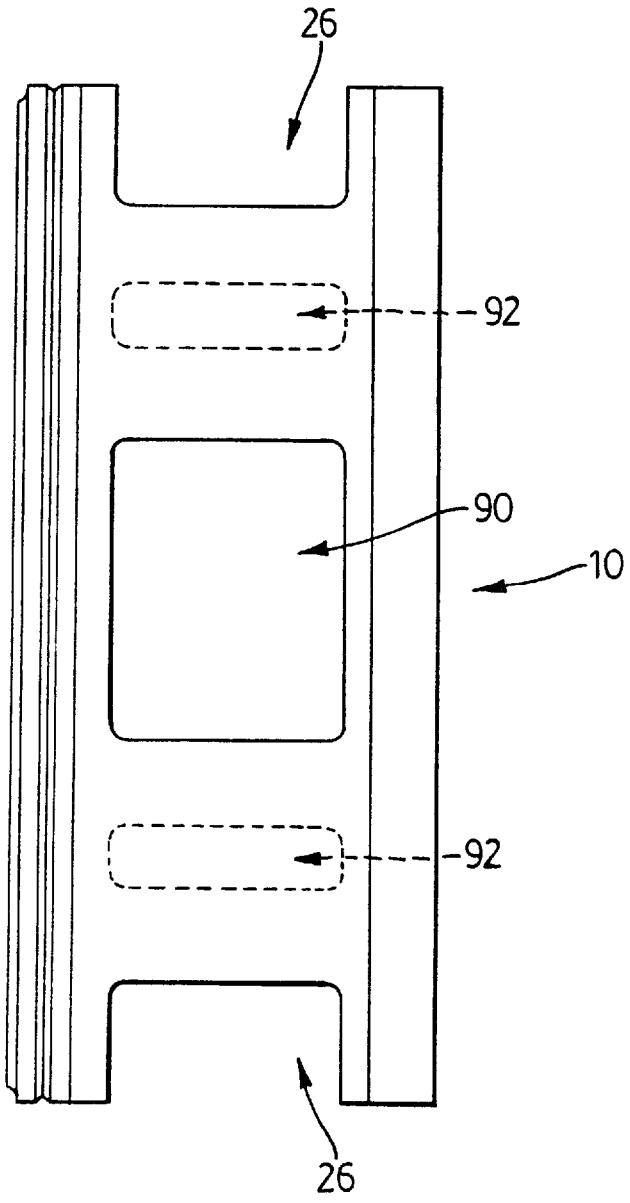
FIG. 13 is a plan view of an alternate configuration of a brick according to the present invention.

In contrast, the blade of FIGS. 11 and 12 operating at the above-mentioned speed will produce the desired contour without severely deforming the green brick, however it will also cause day to flow across the apertures 24 and partial apertures 26 as indicated at 27. This may be used advantageously if it is desired to close certain of the apertures to minimize the weight of the brick and the amount of mortar required to set the stacked brickwork. The size of the apertures, consistency of day, blade speed and dimensions and feed rate of the brick may be varied so that smaller apertures are closed whereas larger apertures are substantially left open. FIG. 13 illustrates a brick 10 wherein partial apertures 26 and central aperture 90 are left open but smaller apertures 92 shown in dashed lines are covered or "smeared over".

In instances where a lightweight brick is suitable and reinforcing rods are not required, a brick having all of the apertures smeared over on at least the bed face 20 may be used. Preferably such a brick will have recesses extending into the header faces 16 and 18 to admit mortar or grout between adjacent brick. As the provision for mortar or grout flow would be diminished by the blockage of the apertures 24 by the smearing, such brick would probably best be laid by pouring mortar or grout along each course prior to placement of the next course.

Figure 15:
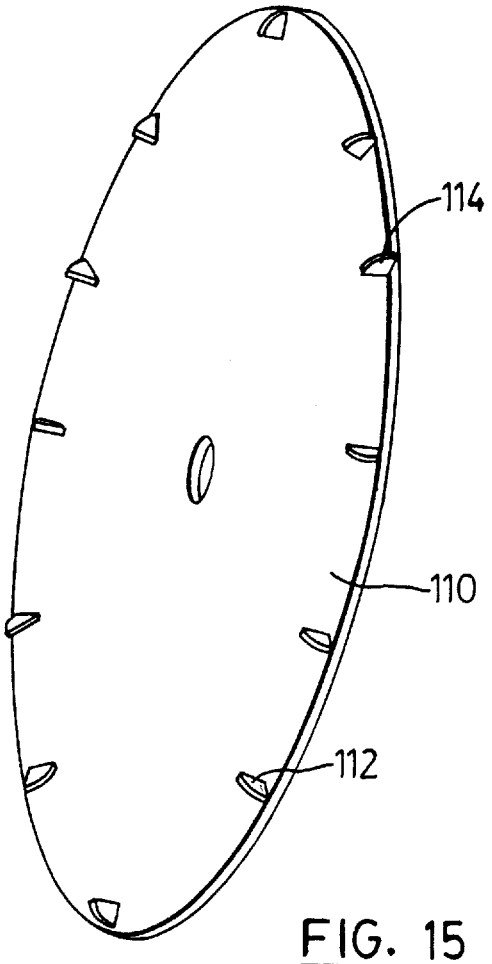
FIG. 15 is a perspective view of a cutting blade for shaping a simulated mortar joint according to the present invention.
Figure 14:
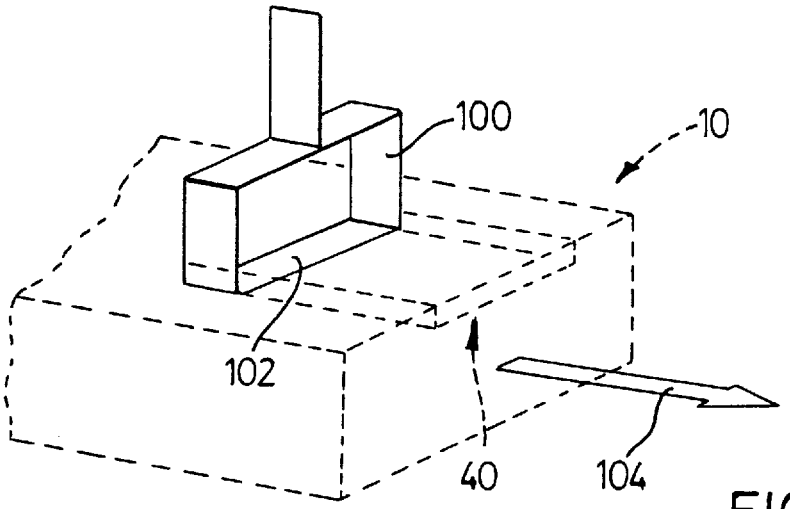
FIG. 14 is a perspective view of a cutting blade.

Alternatively, the brick 10 may be shaped using a stationary blade such as the blade 100 illustrated in FIG. 14. The blade 100 is supported so that its lower member 102 is correctly positioned to cut a recess 40 into the brick 10. The brick 10 is moved in the direction of arrow 104 past the blade 100. Alternatively, the brick 10 may be stationary while the blade 100 moves or both could be moved simultaneously in opposite relative directions The edges 34, 36 and 38 may be cut using a cutting blade such as illustrated at reference 110 in FIG. 15. The blade 110 is generally circular, having curved teeth 112 extending outwardly from a face of the blade about its perimeter. The cutting blades 110 have a curved outer edge 114 having a profile resembling that of the desired mortar joint shape. Suitable results have been obtained using a cutting blade such as illustrated in FIG. 15 having 12 to 24 cutting tips 112, a diameter of approximately 7", rotating at approximately 1720 rpm.

Although above blade speeds, dimensions and configurations have yielded satisfactory test results, in practice it will no doubt be necessary to vary the dimensions and speeds to obtain a desired product throughout. Furthermore, different portions of the cut may be made using different blades. For example, smearing over of certain apertures may be carried out with one type of blade and the mortar stop and edge contouring with different types of blades.

Figure 16:
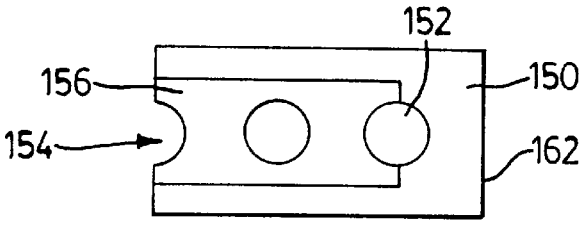
FIG. 16 is a top plan view of a corner brick according to the present invention.
Figure 17:
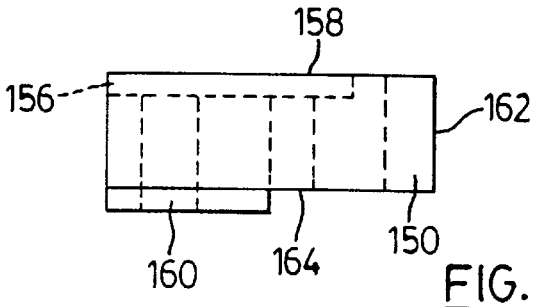
FIG. 17 is a front elevation of a corner brick according to the present invention.

It will be appreciated that because of the tongue and groove configuration of the above block, they would not be usable without modification in corners. Accordingly, a different configuration such as illustrated in FIGS. 16 and 17 is used for corner joints. The brick shown in FIGS. 16 and 17 are identified by reference 150. For the sake of clarity, such things as the simulated mortar joints and mortar stops have been omitted, however they would nonetheless be applicable in practice.

The brick 150 include at least one aperture 152 and once partial aperture 154. The brick has a groove 156 extending into the top bed face 158. The recess 156 does not run the entire length of the brick 110, but rather stops at the aperture 152 adjacent the end 162.

The brick 150 has a projection 160 extending from the bottom bed face 164. The projection 160 does not run the entire length of the brick but rather stops approximately one brick-width from the end 162.

Figure 18:
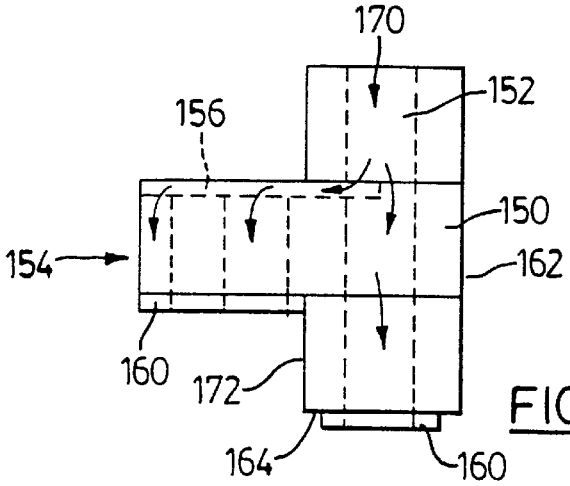
FIG. 18 is a front elevation of a corner joint.
Figure 19:
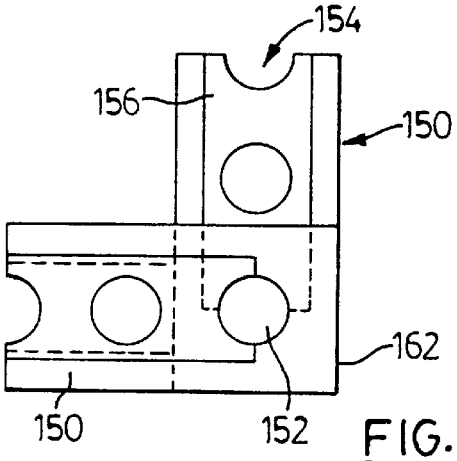
FIG. 19 is a top plan view of a corner joint.

FIGS. 18 and 19 illustrate how brick as illustrated in FIGS. 16 and 17 may be stacked in a corner. The brick are stacked with the portions adjacent the end 162, one above the other. As the projection 160 stops short of the end 162, the projection 160 stops adjacent the face 172 of the brick 150. The apertures 152 lie directly one above the other. As the groove 156 extends into the aperture 152, mortar flowing into the aperture 152 will, as indicated by arrows 170, flow into the groove 156 and from the groove 156 into the remaining apertures or partial apertures 154.

Figure 20:
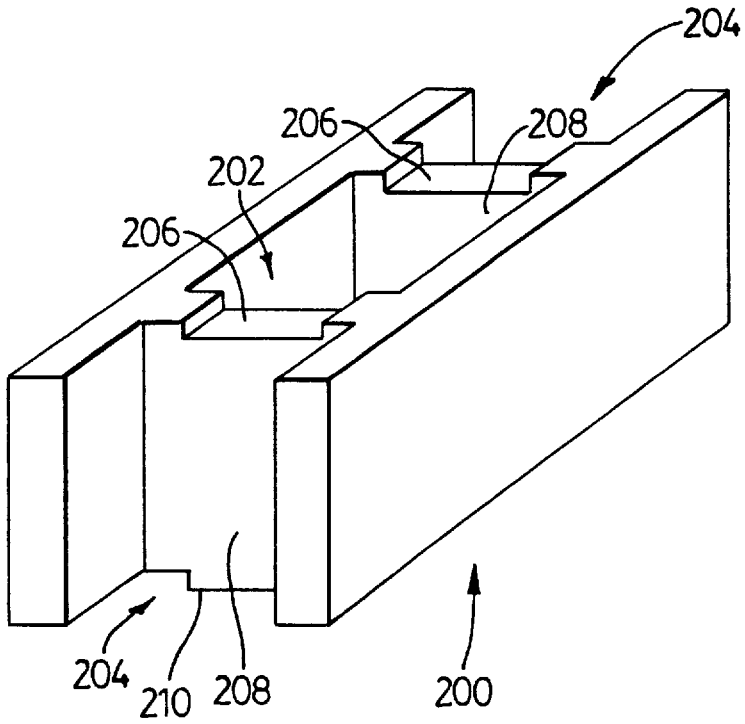
FIG. 20 is a perspective view of an alternative embodiment of a brick according to the present invention.

FIG. 20 illustrates another configuration of a brick 200 according to the present invention. The main difference between the brick 200 and the brick 10 illustrated in FIG. 1 is that the apertures 202 and partial apertures 204 are wider than the two grooved portions or recesses 206. Accordingly, rather than having a single groove running the length of the brick, the grooved portions 206 extend only into the webs 208. Similarly, rather than having aprojection running the length of the brick 200, the brick 200 has a projection 210 extending from each web 208 opposite the grooved portion 206.

In use, the projections 210 would nest within the grooved portions 206 for alignment purposes, much the same as with the brick 10 described above. It is intended that the expression "groove" be interpreted broadly enough to cover both embodiments. Although mortar stops and simulated mortar joints are not illustrated in FIG. 20, it will be appreciated that the brick of FIG. 20 may be provided with such features.

It is intended that the above detailed description be interpreted in an illustrative rather than a restrictive sense as variations to the exact embodiments described may be apparent to those skilled in the relevant art while remaining within the scope of the invention as defined by the claims set out below.

The embodiment of the invention in which an exclusive in which an exclusive property or privilege is claimed are defined as follows:

1. A brick being secured to another similar brick or bricks by means of mortar or grout, said brick comprising:

a front face, a rear face, a pair of header faces, a top bed face, a bottom bed face, a recess extending lengthwise into said top bed face along a center portion of said top bed face;

a projection extending lengthwise from said bottom bed face along a center portion of said bottom bed face;

said projection contoured to register at least along an edge with the recess of an underlying brick to align said brick and to define a space with mortar or grout;

a recess extending into at least one of said header faces to partially define an aperture which in conjunction with an adjacent header face of an adjacent brick defines an aperture having mortar or grout between said adjacent header faces into said aperture;

said front face having contouring thereon at least partially resembling a contour of a mortar joint whereby said contouring of said front faces of adjacently stacked brick combined resemble the appearance of mortar joints between said brick;

a groove extending around the perimeter of said brick parallel to and inwardly from said front face to at least partially define a mortar stop adjacent to said front faces;

whereby any mortar or grout in excess of a volume defined by said apertures and said recess of said brick flows into said groove.

2. A brick as claimed in claim 1, further including at least one aperture extending between said bottom bed face and said top bed face, and wherein at least a portion of said aperture extends into said lengthwise recess.

3. A brick as claimed in claim 1 further having at least one aperture extending substantially between said top bed face and a bottom bed face.

4. A brick as claimed in claim 1 having a groove extending around said brick perimeter parallel to but inwardly from said rear face to at least partially define a further mortar stop adjacent said rear face.

5. A brick as claimed in claim 1 for use in corners wherein said recess in said top face runs from a first of said header faces substantially but not all of the way to an opposite of said header faces and said projection runs from said first of said header faces to a distance generally corresponding to a point of a width of a brick from said opposite of said header faces.

6. A brick as claimed in claim 1 further having a recess extending into one of said header faces, and a projection extending from the other header face; and wherein dimensions of said recess and said projection in said header faces being selected so that the projection will register with the recess in the header face of an adjacent brick to align said brick and to define a space that receives mortar or grout between said adjacent header faces.

7. A brick as claimed in claim 1 further having a recess extending into one of said header faces, and a projection extending from the other header face; and wherein dimensions of said recess and said projection in said header faces being selected so that the projection will register with the recess in the header face of an adjacent brick to align said brick and to define a space that receives mortar or grout between said adjacent header faces.

8. A brick as claimed in claim 4 further having a recess extending into one of said header faces, and a projection extending from the other header face; and wherein dimensions of said recess and said projection in said header faces being selected so that the projection will register with the recess in the header face of an adjacent brick to align said brick and to define a space that receives mortar or grout between said adjacent header faces.

9. A brick being secured to another similar brick or bricks by means of mortar comprising:

a top bed face, a bottom bed face, a pair of header faces, a front face a rear face, a partial aperture extending into each said header face, said partial aperture running between said top bed face and said bottom bed face;

at least one aperture extending between said top bed face and said bottom bed face;

a recess extending lengthwise into said top bed face running between said at least one aperture and said partial apertures along a center portion of said to bed face;

a projection extending lengthwise from said bottom bed face along a center portion of said bottom bed face and configured to register with at least a portion of said recess of an underlying brick to align said brick one above the other and to provide a space between said projection and said recess;

wherein at least the edge of said front face adjacent said top bed face and an edge of one of said header faces are contoured to resemble at least a portion of a mortar joint;

a groove extending around the perimeter of said brick parallel to and inwardly from said front face to at least partially define a mortar stop adjacent to said front face;

whereby any mortar or grout in excess of a volume defined by said aperture and said recess of said brick flows into said groove.

10. A brick as claimed in claim 9 wherein said apertures and said partial apertures are spaced apart to register with said apertures and said partial apertures of an overlying brick and an underlying brick when said brick is stacked in running bond, thereby forming columns for receiving reinforcing members extending into said brick stacked in running bond.

11. A brick as claimed in claim 9, further having a recess extending into one of said header faces, and a projection extending from the other header face; and wherein dimensions of said recess and said projection in said header faces being selected so that the projection will register with the recess in the header face of an adjacent brick to align said brick and to define a space that receives mortar or grout between said adjacent header faces.

12. A method of erecting a brick structure comprising the steps of:

i) stacking a plurality of courses of brick according to claim 2 in running bond with said projections and recesses registering to align said brick and to define a fluid conduit admitting mortar or grout between adjacent faces of said brick; and ii) pouring mortar or grout into at least some of said apertures to flow through said fluid conduit and form a continuous joint around said brick between said adjacent faces leaving said front face and said rear face exposed.

13. A method of erecting a brick structure comprising the steps of:

i) stacking a row of brick according to claim 1 adjacent one another with said header faces abutting;

ii) placing mortar or grout into said recess in said top bed faces;

iii) placing a course of said brick above said top bed faces with said projections and recesses registering to align said brick; and iv) repeating steps ii and iii above until said brick structure attains a desired height.

14. A brick being secured to another similar brick or bricks by means of mortar or grout, said brick comprising:

a top bed face, a bottom bed face, a pair of header faces, a front face a rear face, whereby any mortar or grout in excess of a volume defined by said apertures and said recess of said brick flows into said first groove and said further groove.

* * * * *